US011402183B2

(12) United States Patent
Ozanne et al.

(10) Patent No.: US 11,402,183 B2
(45) Date of Patent: Aug. 2, 2022

(54) ARROW BENDING AXIS ORIENTATION

(71) Applicant: MCP IP, LLC, Sparta, WI (US)

(72) Inventors: Jeffrey J. Ozanne, Norwalk, WI (US); Mathew A. McPherson, Norwalk, WI (US); John R. Scovil, Onalaska, WI (US); Mark J. Hayes, Sparta, WI (US); Jeffrey A. Ozanne, La Crosse, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/593,747

(22) Filed: Oct. 4, 2019

(65) Prior Publication Data

US 2020/0141707 A1 May 7, 2020

Related U.S. Application Data

(60) Provisional application No. 62/742,105, filed on Oct. 5, 2018.

(51) Int. Cl.
*F42B 6/04* (2006.01)
*F42B 6/06* (2006.01)

(52) U.S. Cl.
CPC . *F42B 6/06* (2013.01); *F42B 6/04* (2013.01)

(58) Field of Classification Search
CPC ..... F42B 6/04
See application file for complete search history.

(56) References Cited

U.S. PATENT DOCUMENTS

| | | | | |
|---|---|---|---|---|
| 2,554,012 | A * | 5/1951 | Cohen | F42B 12/362 473/581 |
| 3,995,860 | A | 12/1976 | Manspeaker | |
| 4,210,330 | A | 7/1980 | Kosbab | |
| 4,212,463 | A * | 7/1980 | Repinski | F42B 6/04 473/581 |
| 4,398,354 | A | 8/1983 | Finlay | |
| 4,410,184 | A | 10/1983 | Anderson | |
| 4,656,994 | A | 4/1987 | Jenks | |
| 4,706,965 | A | 11/1987 | Schaar | |
| 4,866,810 | A | 9/1989 | Kudlacek | |
| 5,067,731 | A | 11/1991 | Bickel | |
| 5,273,293 | A | 12/1993 | Lekavich | |
| 5,290,044 | A | 3/1994 | Easton et al. | |
| 5,361,747 | A | 11/1994 | Laabs | |
| 5,417,439 | A | 5/1995 | Bickel | |
| 5,516,117 | A | 5/1996 | Rangel | |
| 5,919,105 | A | 7/1999 | Summers | |
| 5,921,875 | A | 7/1999 | Bickel | |
| 6,129,642 | A * | 10/2000 | DonTigny | F42B 6/04 473/578 |
| 6,142,895 | A | 11/2000 | Jason | |
| 6,203,457 | B1 | 3/2001 | Snook | |
| 6,390,642 | B1 | 5/2002 | Simonton | |
| 6,428,433 | B1 | 8/2002 | Liechty, II | |
| 7,485,056 | B2 | 2/2009 | Sullivan et al. | |
| 8,057,330 | B2 | 11/2011 | Blosser et al. | |
| 8,251,845 | B2 | 8/2012 | Bay | |
| 8,257,208 | B2 | 9/2012 | Harding | |
| 8,267,815 | B2 | 9/2012 | Braun et al. | |

(Continued)

*Primary Examiner* — John A Ricci
(74) *Attorney, Agent, or Firm* — Laabs Intellectual Property

(57) ABSTRACT

In some embodiments, an arrow comprises a shaft, a nock and a structural asymmetry orienting a weak bending axis of the arrow.

16 Claims, 20 Drawing Sheets

(56) References Cited

U.S. PATENT DOCUMENTS

| | | | |
|---|---|---|---|
| 8,337,342 | B1 | 12/2012 | Huang |
| 8,342,990 | B1 | 1/2013 | Price |
| 8,403,777 | B1 | 3/2013 | Huang |
| 9,068,804 | B2 | 6/2015 | McPherson |

* cited by examiner

ARROW BENDING AXIS ORIENTATION

CROSS-REFERENCE TO RELATED APPLICATIONS

This application claims the benefit of U.S. patent application No. 62/742,105, filed Oct. 5, 2018, the entire content of which is hereby incorporated herein by reference.

BACKGROUND OF THE INVENTION

This invention relates generally to archery and more specifically to arrows and similar projectiles, which can be launched from a bow.

Arrows are generally known in the art. Arrows are known to bend along their length during launch and to rebound and oscillate in bending deflection as the arrow travels toward the target. An arrow "spine" is often defined in the art as a measurement of lateral deflection of an arrow in response to a predetermined lateral bending load.

An arrow shaft often has a cylindrical shape and is designed to have uniform strength characteristics about its circumference and along its length; however, real-world conditions generally prevent arrow shafts from having truly uniform strength characteristics. Although an arrow may appear uniform in strength to the naked eye, spine testing will generally reveal strength differentials as the arrow is rotated, allowing an archer to find and orient a "strong axis" and/or a "weak axis" for the arrow. An archer can achieve more consistent shooting results if the different arrows used by the archer are as similar as possible. Therefore, archers will often measure arrows to find and orient a particular axis. For example, an archer might measure a group of arrows to find the weak axis for each arrow, then orient the nock of each with respect to the weak axis in a similar manner. This helps to ensure that the weak axis location/vector is similar from arrow to arrow.

Passively measuring each arrow to determine relative strength is a laborious process, and the results can be inconsistent. There remains a need for novel arrow configurations that are capable of providing greater consistency from arrow-to-arrow. There remains a need for novel arrow configurations where a stronger and/or weaker axis can be located without spine deflection testing.

All U.S. patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an arrow comprises a shaft, a nock and a structural asymmetry orienting a weak bending axis of the arrow.

In some embodiments, an asymmetrical feature extends for a portion of the length of the shaft. In some embodiments, an asymmetrical feature extends an entire length of the shaft.

In some embodiments, a first cross-sectional half of the shaft is shaped differently from a second cross-sectional half of the shaft.

In some embodiments, an asymmetrical feature is formed in an outer surface of the shaft.

In some embodiments, the shaft comprises a tube. In some embodiments, an asymmetrical feature is formed in an inner surface of the tube.

In some embodiments, the arrow comprises a stiffener and the stiffener comprises the structural asymmetry.

In some embodiments, a stiffener is oriented within the tube. In some embodiments, a length of a stiffener is less than a length of the tube. In some embodiments, the arrow comprises multiple stiffeners spaced along a length of the tube. In some embodiments, a stiffener extends for an entire length of the tube.

In some embodiments, a stiffener comprises an asymmetrical cross-sectional shape.

In some embodiments, a stiffener comprises a symmetrical shape and further comprises a first material and a second material. The structural characteristics of the first material are different from the structural characteristics of the second material, so the stiffener provides a strength asymmetry.

In some embodiments, a stiffener cross-section comprises a T-shape. In some embodiments, a stiffener cross-section comprises an X-shape. In some embodiments, a stiffener cross-section comprises an arcuate shape.

In some embodiments, a stiffener is attached to the nock. In some embodiments, the nock comprises a cavity, slit, notch or the like, and a portion of the stiffener is oriented in the nock.

In some embodiments, the shaft comprises a groove. In some embodiments, the shaft comprises a plurality of apertures and/or cavities. In some embodiments, the plurality of apertures and/or cavities are aligned with one another and extend parallel to a central axis of the shaft.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
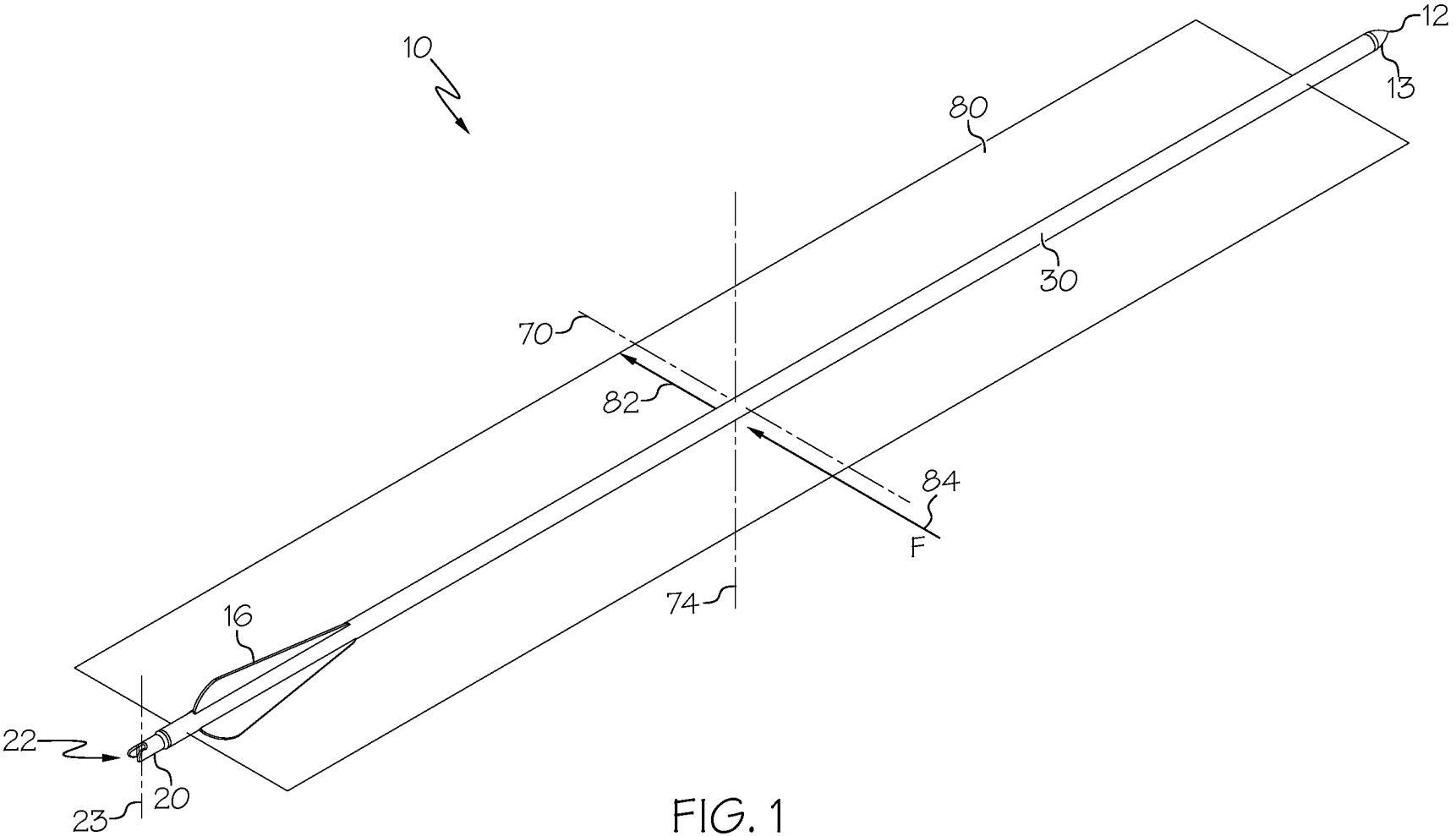
FIG. 1 shows an embodiment of an arrow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an arrow 10. In some embodiments, an arrow 10 comprises a shaft 30, an arrowhead 13, a nock 20 and fletching 16. In some embodiments, the nock 20 comprises a notch 22, for example arranged to receive a bowstring. In some embodiments, the notch 22 defines an axis 23, and a portion of a bowstring can become aligned upon the axis 23 when the portion is oriented in the notch 22.

In some embodiments, a weak bending plane 80 for the arrow 10 is defined. In some embodiments, the weak bending plane 80 has a specific predetermined orientation with respect to the axis 23 of the notch 22. When an arrow is launched, forces applied to the nock 20 end of the arrow 10 can cause a buckling deformation, for example where a mid-portion of the shaft 30 displaces laterally from its ordinary position along a central axis of the arrow 10. An arrow 10 will typically deform about its weakest bending axis, and the lateral displacement of the shaft 30 will comprise movement in the weak bending plane 80.

In some embodiments, a cross-section of the arrow 10 will define a strong bending axis 70 and a weak bending axis 74. In some embodiments, deformation of the shaft 30 in the weak bending plane 80 amounts to deformation of the shaft 30 about the weak bending axis 74. In some embodiments, the weak bending plane 80 is orthogonal to the weak bending axis 74. In some embodiments, the strong bending axis 70 is oriented in the weak bending plane 80. In some embodiments, the weak bending axis 74 is parallel to the nock axis 23. In some embodiments, the weak bending plane 80 is orthogonal to the nock axis 23. In some embodiments, the strong bending axis 70 is orthogonal to the nock axis 23.

In some embodiments, a weak deflection vector 82 for the arrow 10 is defined. In some embodiments, a weak deflection vector 82 comprises a vector oriented in a radial direction and indicating the direction of greatest lateral deflection of the arrow 10 in response to a lateral bending load 84. As shown in FIG. 1, the lateral bending load 84 causes bending around the weak bending axis 74 and deflection of the arrow 10 in the weak bending plane 80. In some embodiments, the weak deflection vector 82 represents the weaker of two radial vectors oriented in the weak bending plane 80. In some embodiments, the weak bending vector 82 is parallel to or collinear with the strong bending axis 70. In some embodiments, the weak bending vector 82 is orthogonal to the weak bending axis 74.

In some embodiments, the nock 20 is rotated 90 degrees from the orientation shown in FIG. 1, thereby orienting the nock axis 23 parallel to the strong bending axis 70 and orthogonal to the weak bending axis 74.

In some embodiments, the arrow 10 comprises a structural asymmetry that positively locates the weak bending axis 74. For example, in some embodiments, the shaft 30 is selectively configured to specifically locate a portion of weakness to set the location of the weak bending axis 74. In some embodiments, the arrow 10 comprises a structural asymmetry that positively locates the strong bending axis 70. For example, in some embodiments, the shaft 30 is selectively reinforced to specifically locate a portion of strength to set the location of the strong bending axis 70. In some embodiments, the structural asymmetry is hidden and not visible on the outer surfaces of the arrow 10.

Figure 2:
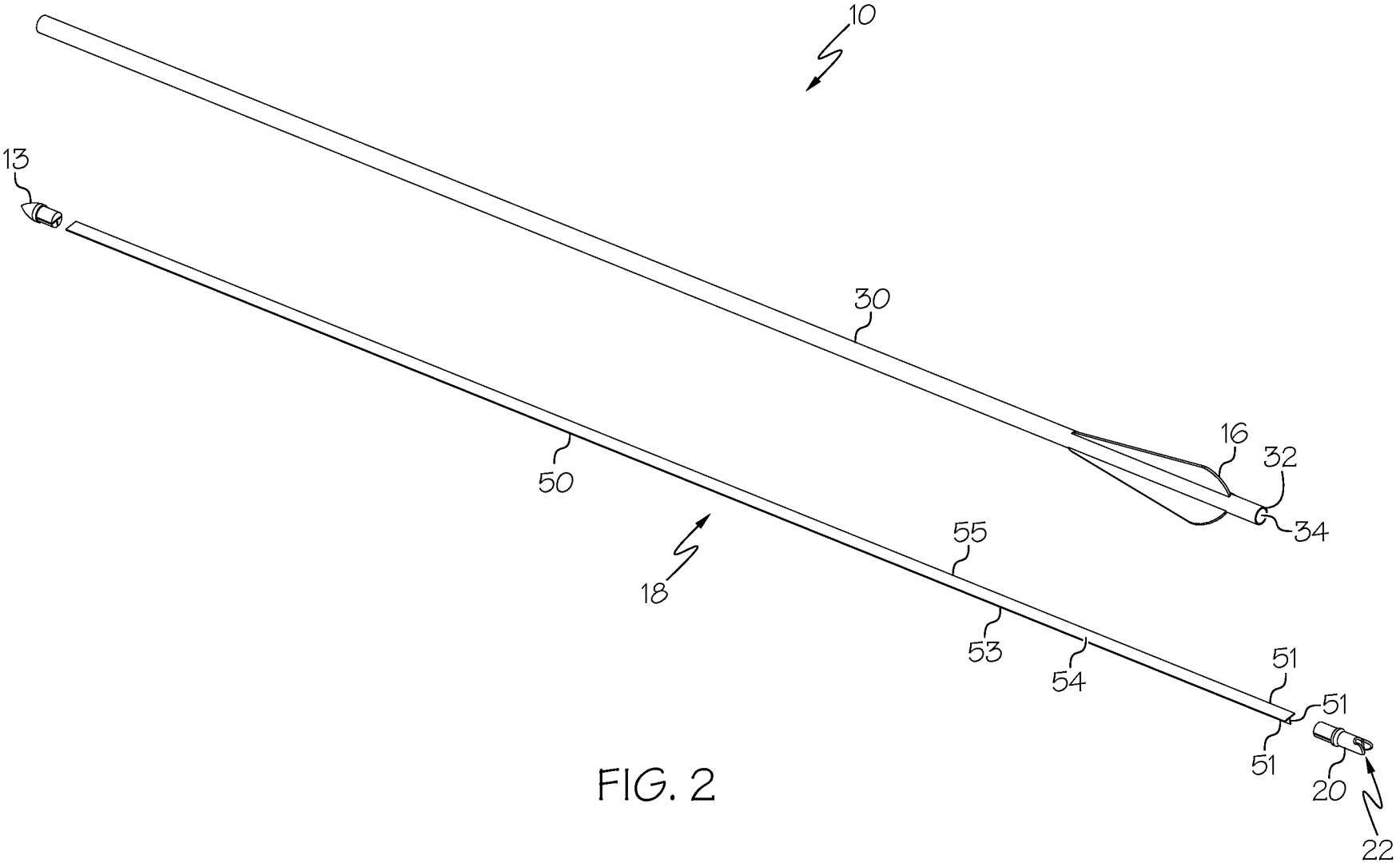
FIG. 2 shows an exploded view of another embodiment of an arrow.
Figure 3:
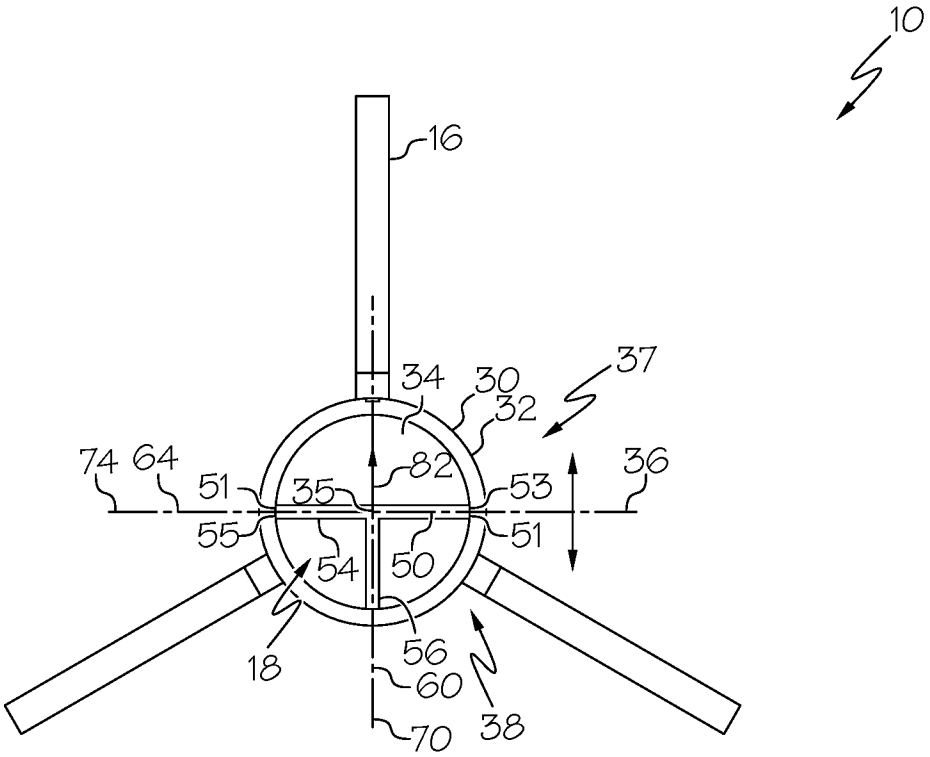
FIG. 3 shows a cross-sectional view of the embodiment of FIG. 2.

FIG. 2 shows an exploded view of another embodiment of an arrow 10. FIG. 3 shows a cross-sectional view of the embodiment of the arrow 10 shown in FIG. 2. In some embodiments, the shaft 30 comprises a tube 32 defining a cavity 34. The shaft 30 can be made from any suitable material and can be formed using any suitable method.

In some embodiments, an arrow 10 comprises a stiffener 50. In some embodiments, the stiffener 50 comprises an asymmetry 18. In some embodiments, a stiffener 50 is bonded to the shaft 30. In some embodiments, a stiffener 50 is oriented within the cavity 34 of the tube 32. In some embodiments, one or more surfaces 51 of the stiffener 50 that contact the tube 32 are bonded to the tube 32.

In some embodiments, a stiffener 50 reinforces the arrow 10 and provides strength. In some embodiments, the stiffener 50 influences the location of the strong bending axis 70 and the weak bending axis 74 for the arrow 10.

A stiffener 50 can have any suitable size and shape, and can be made from any suitable material. A stiffener 50 can span any suitable length of the arrow 10. In some embodiments, an arrow 10 can comprise multiple stiffeners 50.

In some embodiments, a cross-sectional shape of a stiffener 50 is asymmetrical, and the stiffener 50 comprises a strong bending axis 60 and a weak bending axis 64. In some embodiments, the strong bending axis 60 is oriented orthogonally to the weak bending axis 64.

In some embodiments, the stiffener 50 sets the location of the strong bending axis 70 and the weak bending axis 74 of the arrow 10, and the strong bending axis 60 of the stiffener is aligned upon the strong bending axis 70 of the arrow, and the weak bending axis 64 of the stiffener 50 is aligned upon the weak bending axis 74 of the arrow 10.

In some embodiments, a stiffener 50 comprises a cross-member 54 comprising a continuous structure that spans across the cavity 34. In some embodiments, a cross-member 54 comprises a first side 53 and a second side 55. In some embodiments, the first side 53 is attached to an interior surface of the tube 32 and the second side 55 is attached to an interior surface of the tube 32. In some embodiments, the cross-member 54 is arranged to span across a diameter of the shaft 30. In some embodiments, the cross-member 54 spans across a central axis 35 of the cavity 34.

In some embodiments, a cross-member 54 defines the strong bending axis 60 of the stiffener 50. In some embodiments, the cross-member 54 is oriented orthogonally to the strong bending axis 60.

In some embodiments, a stiffener 50 comprises a stem 56 portion. In some embodiments, a stem 56 spans between a portion of the shaft 30 and another portion of a stiffener 50, such as a cross-member 54. In some embodiments, a stem 56 comprises a first side attached to the shaft 30 and a second side attached to a cross-member 54.

In some embodiments, a stiffener 50 comprises a T-shaped cross-section. In some embodiments, the cross-member 54 and the stem 56 comprise a T-shape cross-section.

In some embodiments, a bisecting axis 36 bisects a cross-section of the arrow 10 into a first half 37 located to a first side of the bisecting axis 36 and a second half 38 located to a second side of the bisecting axis 36. In some embodiments, the bisecting axis 36 intersects the central axis 35 of the arrow 10.

In some embodiments, a cross-sectional shape of the stiffener 50 is asymmetrical across the bisecting axis 36, such that a portion of the stiffener 50 located in the first half 37 is different from a portion of the stiffener 50 located in the second half 38. In some embodiments, a cross-sectional shape of the tube 32 is symmetrical across the bisecting axis 36.

In some embodiments, an arrow 10 comprises a tube 32, a nock 20 attached to the tube 32, the nock 20 attached to a stiffener 50 oriented within the tube 32, but the stiffener 50 is not directly bonded to the tube 32.

Figure 4:
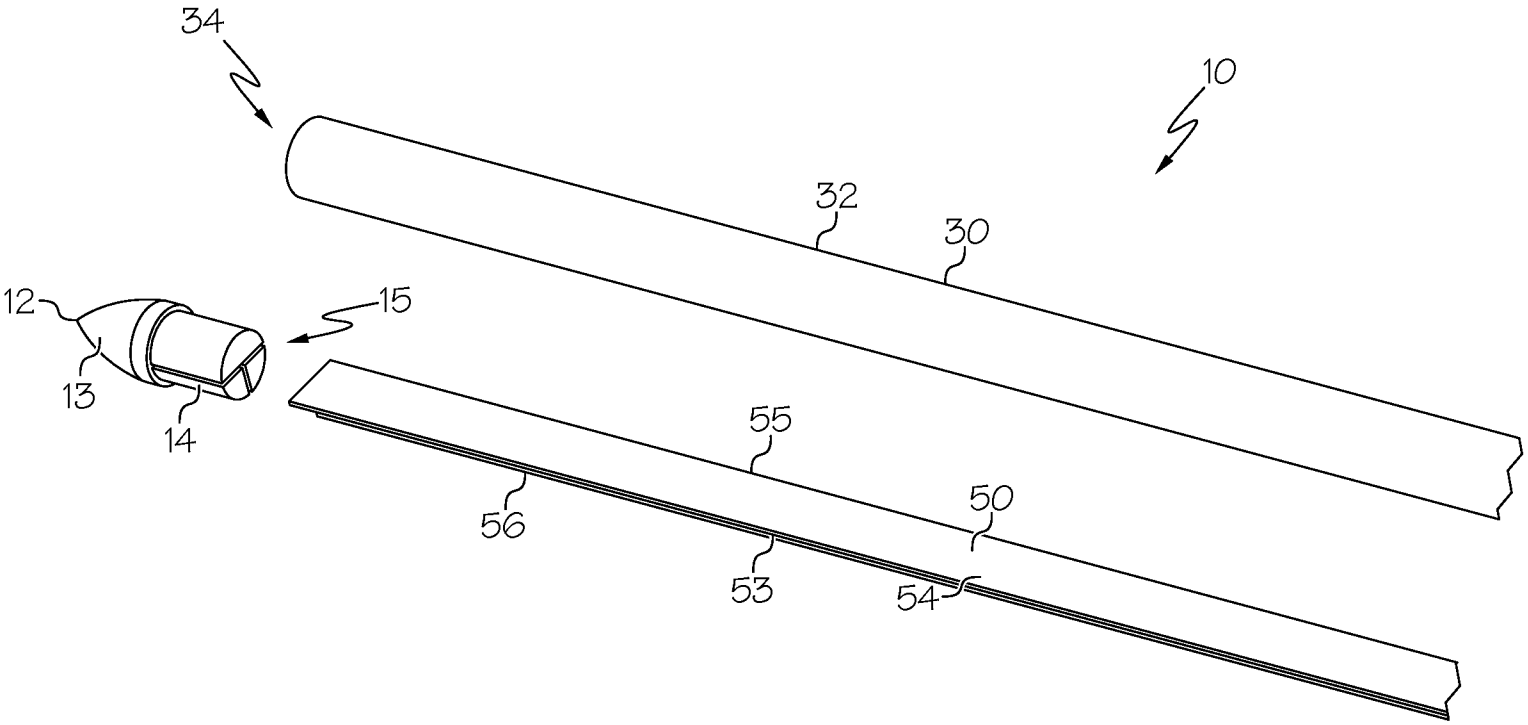
FIGS. 4 and 5 show exploded views of the embodiment of FIG. 2 in greater detail.

FIG. 4 shows a front portion of the embodiment of the arrow 10 of FIG. 2 in greater detail. In some embodiments, the arrowhead 13 is arranged to engage a stiffener 50. In some embodiments, the stiffener 50 is bonded to the arrowhead 13, for example using an adhesive. In some embodiments, an arrowhead 13 comprises a cavity 15 arranged to receive the stiffener 50. In some embodiments, a cross-sectional shape of the cavity 15 is similar to a cross-sectional shape of the stiffener 50.

In some embodiments, an arrowhead 13 comprises a tip 12. In some embodiments, an arrowhead 13 comprises an insert portion 14 that is oriented in the cavity 34 of the shaft 30. In some embodiments, the cavity 15 is formed in the insert portion 14.

Figure 5:
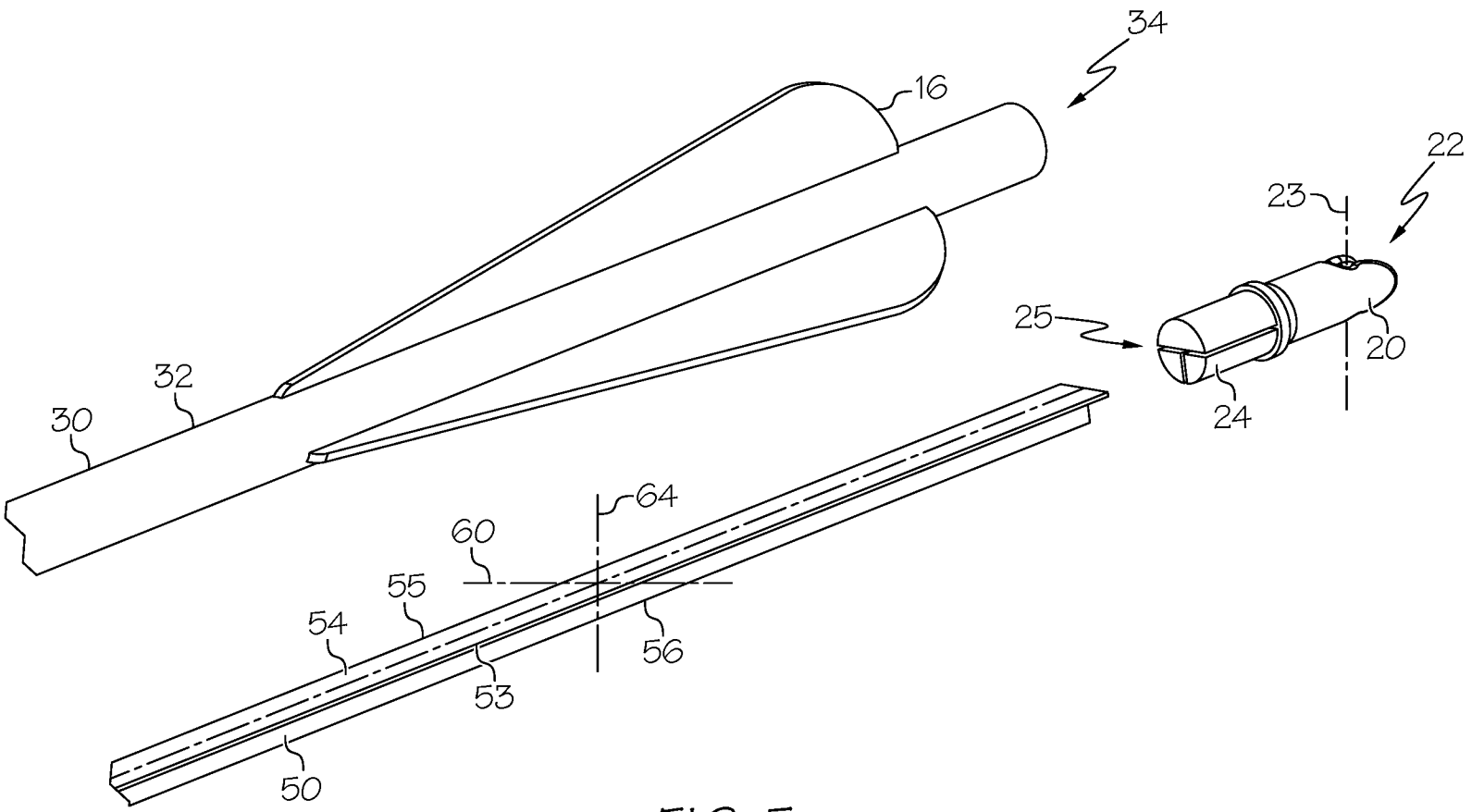

FIG. 5 shows a rear portion 10 of the embodiment of the arrow of FIG. 2 in greater detail.

In some embodiments, the nock 20 comprises a notch 22 arranged to receive a bowstring.

In some embodiments, a stiffener 50 is engaged with the nock 20. In some embodiments, the stiffener 50 is bonded to the nock 20, for example using an adhesive. In some embodiments, a nock 20 comprises a cavity 25 arranged to receive the stiffener 50. In some embodiments, a cross-sectional shape of the cavity 25 is similar to a cross-sectional shape of the stiffener 50.

In some embodiments, a nock 20 comprises an insert portion 24 that is oriented in the cavity 34 of the shaft 30. In some embodiments, the cavity 25 is formed in the insert portion 24.

In some embodiments, the nock 20 is bonded to the shaft 30 and is also bonded to the stiffener 50.

In some embodiments, the strong bending axis 60 of the stiffener 50 is oriented orthogonal to the nock axis 23 defined by the notch 22. In some embodiments, the weak bending axis 64 of the stiffener 50 is oriented parallel to the axis 23 defined by the notch 22.

In various embodiments, a stiffener 50 can span any suitable length portion of the arrow 10. In some embodiments, a stiffener 50 comprises a continuous structure extending the entire length of the shaft 30. In some embodiments, a stiffener 50 is attached to the tip 13 and is attached to the nock 20.

Figure 6:
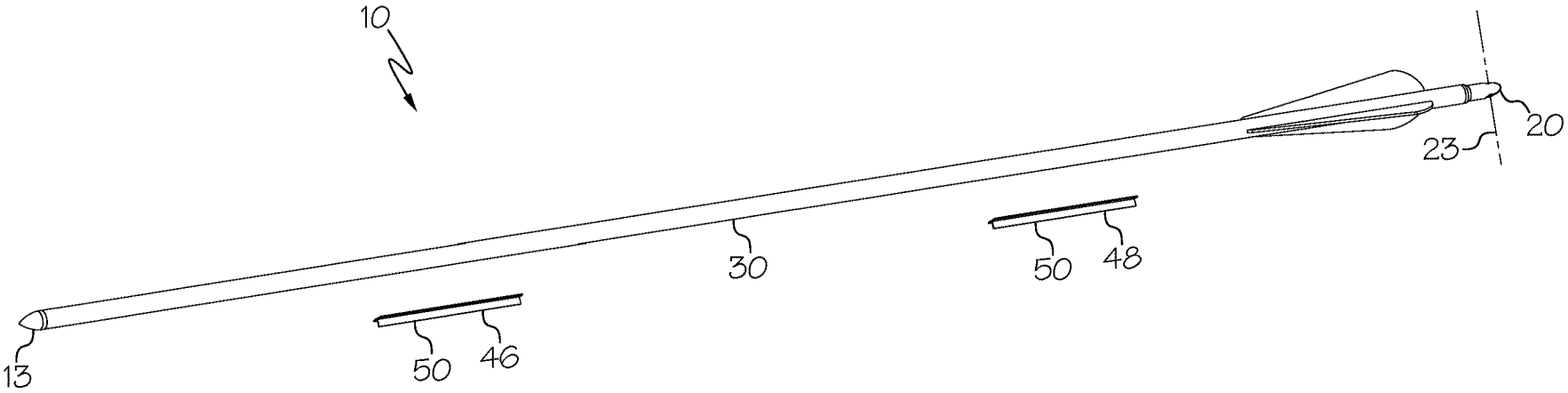
FIG. 6 shows an exploded view of another embodiment of an arrow.
Figure 7:
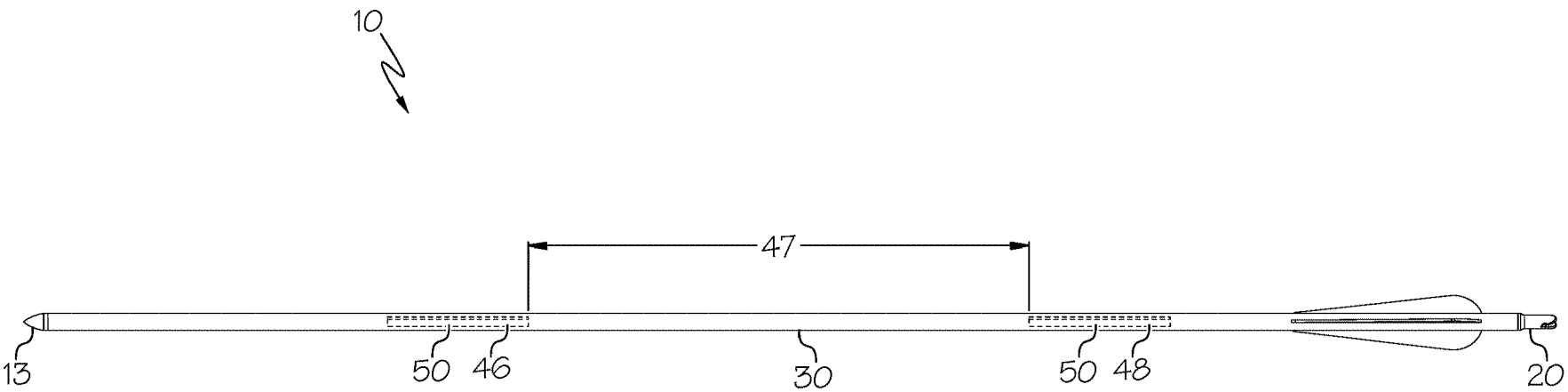
FIG. 7 shows another view of the embodiment of FIG. 6.

FIGS. 6 and 7 show another embodiment of an arrow 10. In some embodiments, an arrow 10 comprises multiple stiffeners 50. FIG. 6 shows the stiffeners 50 exploded from the shaft 30. FIG. 7 shows the lengths of the stiffeners 50 and placement within the shaft 30 for this specific embodiment.

In some embodiments, an arrow 10 comprises a first stiffener 46 and a second stiffener 48. In some embodiments, the first stiffener 46 and second stiffener 48 are spaced along the length of the shaft 30. In some embodiments, the first stiffener 46 is separated from the second stiffener 48 by a gap 47. In some embodiments, the gap 47 is longer than either stiffener 46, 48.

In some embodiments, the first stiffener 46 comprises a cross-sectional shape and rotational orientation similar to the second stiffener 48. In some embodiments, the first stiffener 46 comprises a cross-sectional shape similar to the second stiffener 48, but the stiffeners 46, 48 have different rotational orientations (for example, a vector of asymmetry extending from the first stiffener 46 can extend in a different radial direction from a vector of asymmetry extending from the second stiffener 48. In some embodiments, the cross-sectional shapes of the first stiffener 46 and the second stiffener 48 are different from one another.

In some embodiments, the first stiffener 46 comprises a length similar to the second stiffener 48. In some embodiments, the first stiffener 46 comprises a length that is different from the second stiffener 48.

In some embodiments, a first stiffener 46 can extend to and contact the second stiffener (e.g. no gap 47). This arrangement can fill the arrow shaft 30 such that its contents are similar along its length, but bending forces will not be transferred directly between the first stiffener 46 and second stiffener 48.

The sizing and spacing of various stiffeners 50, 46, 48 can be selected to orient locations of the nodes and anti-nodes of a standing wave vibration that is induced at arrow launch.

Figure 8:
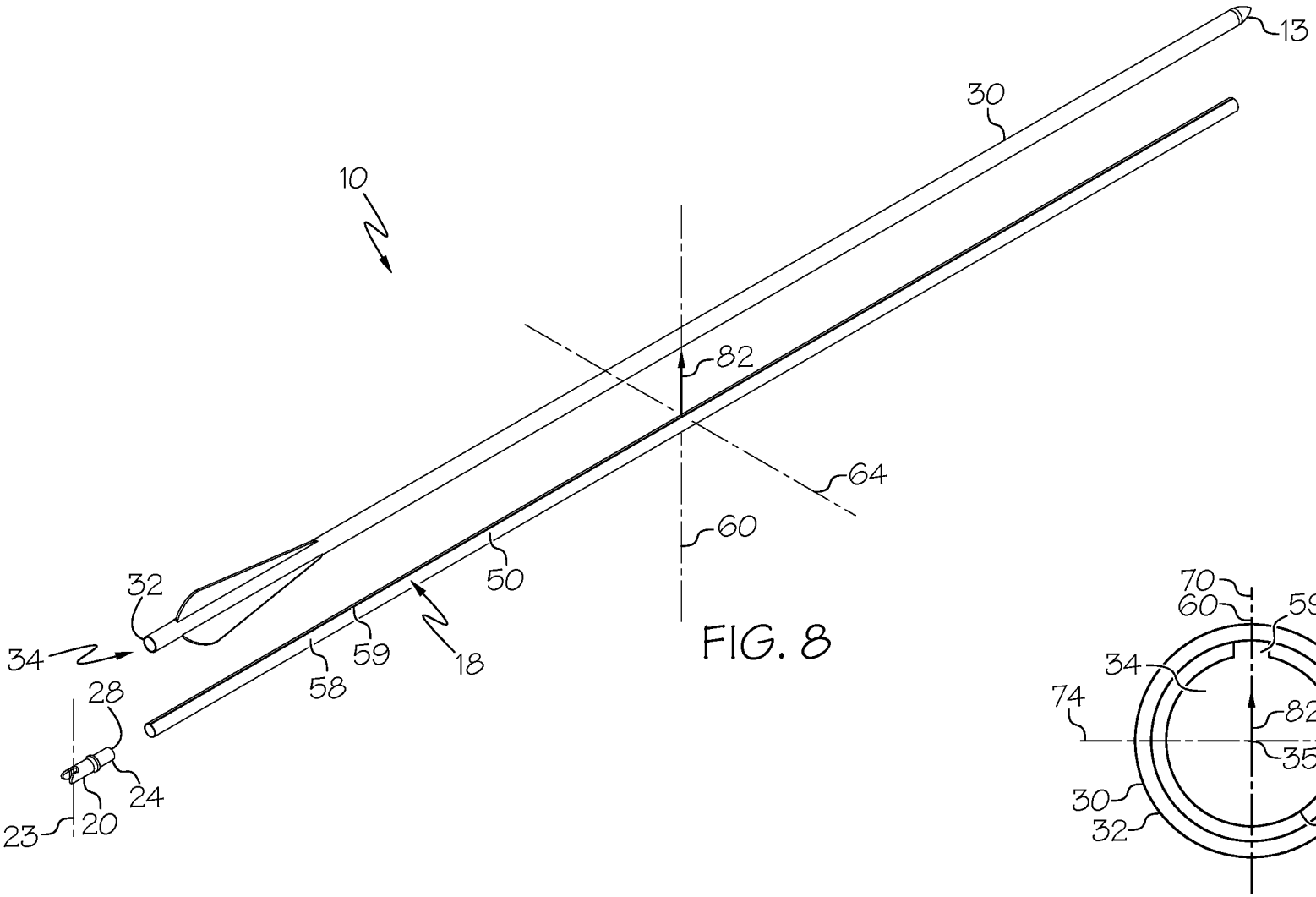
FIG. 8 shows an exploded view of another embodiment of an arrow.
Figure 9:
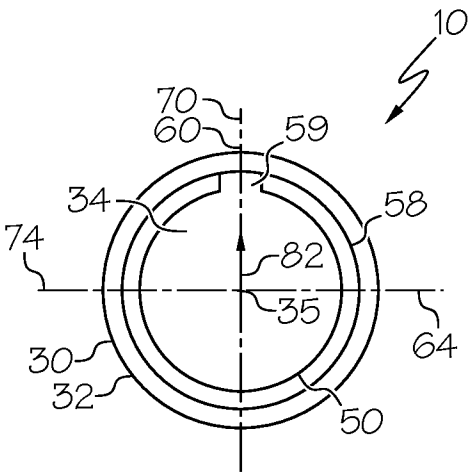
FIG. 9 shows a cross-sectional view of the embodiment of FIG. 8.
Figure 10:
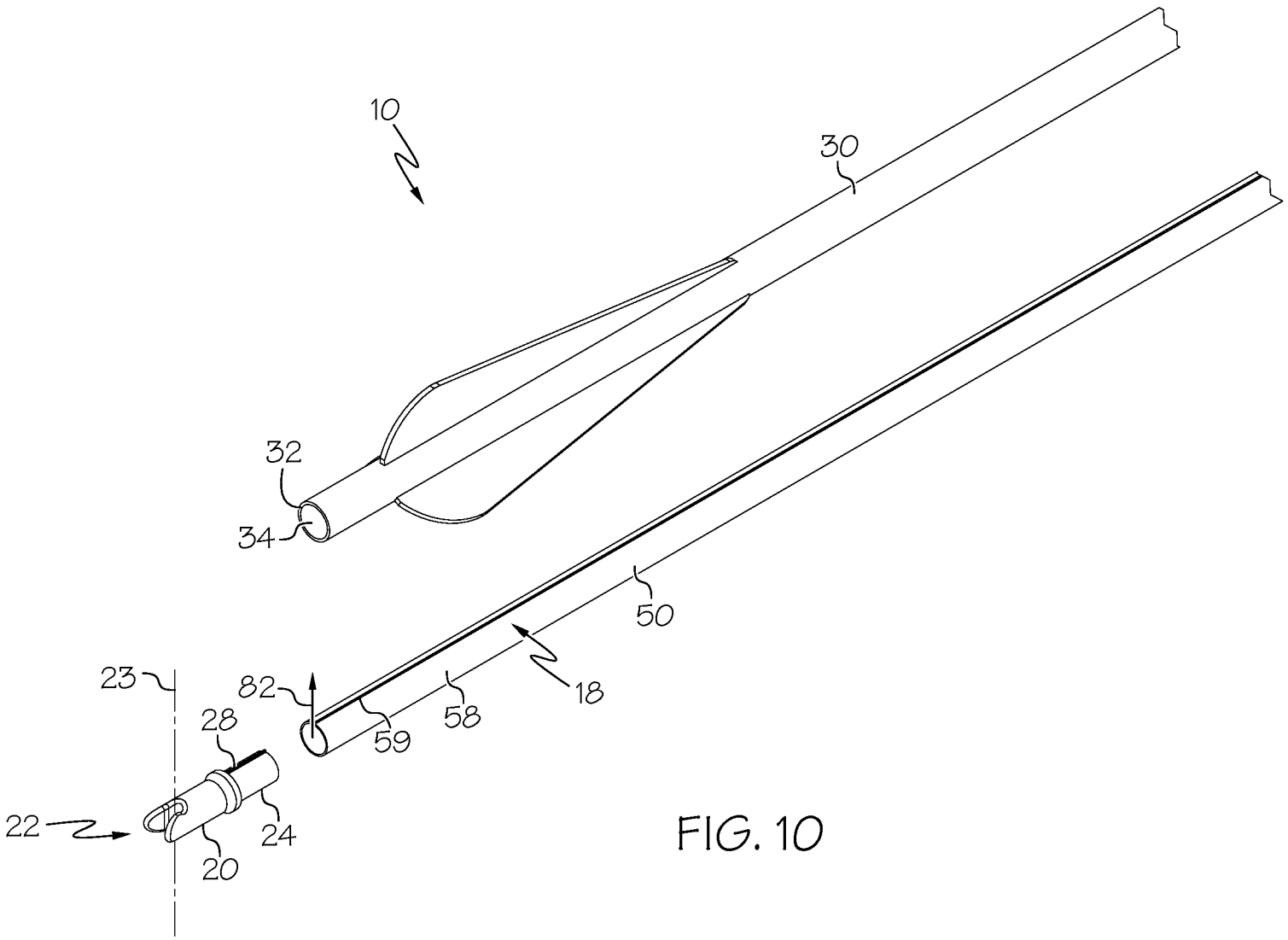
FIG. 10 shows an exploded view of the embodiment of FIG. 8 in greater detail.

FIGS. 8-10 show another embodiment of an arrow 10. FIG. 8 shows an exploded view and FIG. 9 shows a cross-sectional view. In some embodiments, a stiffener 50 comprises a substantially tubular sidewall 58 and an asymmetrical feature 18 such as an aperture 59 or gap in the sidewall. In some embodiments, a stiffener 50 comprises a plurality of apertures 59 aligned on one side of the stiffener 50. In some embodiments, a single aperture 59 comprises a continuous gap or slit that extends along the length of the stiffener 50. In some embodiments, the aperture(s) 59 orient the strong bending axes 60, 70 of the respective stiffener 50 and arrow 10, and the weak bending axes 64, 74 of the respective stiffener 50 and arrow 10. In some embodiments, the aperture(s) 59 orient the weak deflection vector 82.

In some embodiments, a tubular sidewall 58 of the stiffener 50 contacts an inner surface of the tube 32. The stiffener 50 can be attached to the tube using any suitable method, such as an adhesive.

FIG. 10 shows the rear portion of the arrow 10 of FIG. 8 in greater detail. In some embodiments, the nock 20 engages the stiffener 50 to positively orient the weak deflection vector 82 with respect to the nock axis 23.

In some embodiments, the nock 20 comprises an insert portion 24 arranged to be disposed within the stiffener 50. In some embodiments, the nock 20 comprises a key 28 arranged to be disposed within an aperture 59 or slit in the stiffener 50. In some embodiments, the key 28 comprises a protrusion in an outer surface of the insert portion 24. In some embodiments, the key 28 provides the nock 20 with asymmetry.

Figure 11:
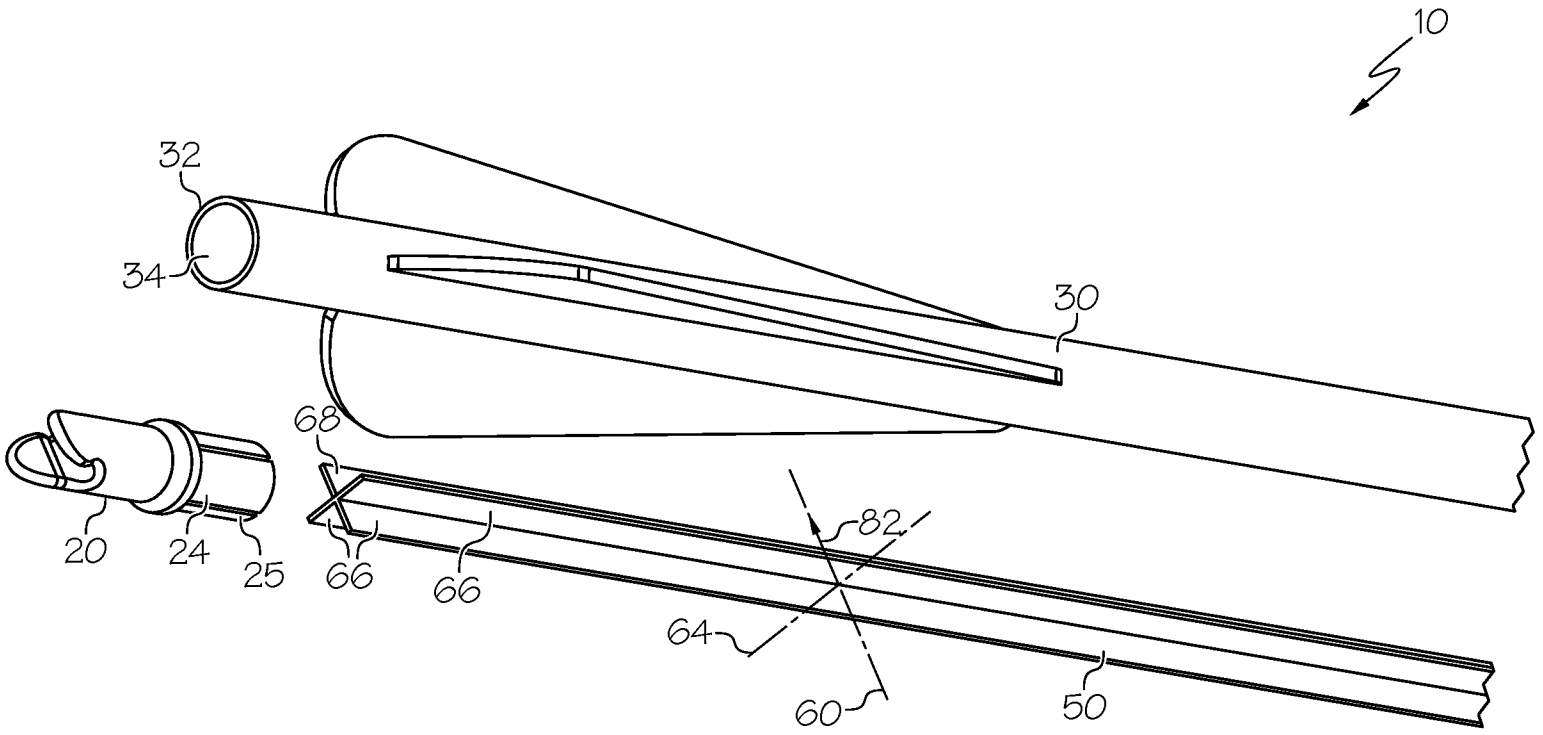
FIG. 11 shows an exploded view of another embodiment of an arrow.
Figure 12:
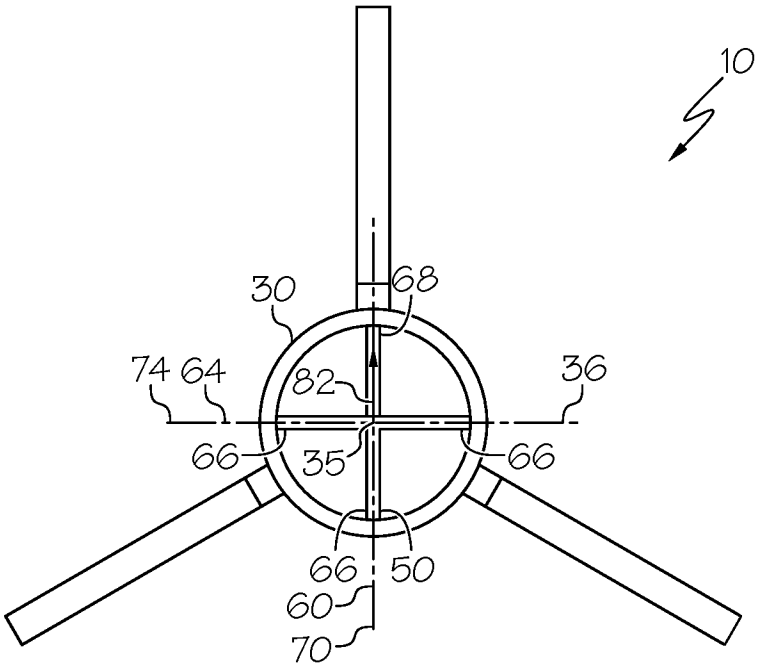
FIG. 12 shows a cross-sectional view of the embodiment of FIG. 11.

FIGS. 11 and 12 show another embodiment of an arrow 10 comprising a stiffener 50.

In some embodiments, a stiffener 50 is configured to have substantially symmetrical weight and shape characteristics, but asymmetrical strength characteristics.

In some embodiments, a stiffener 50 comprises a first portion 66 comprising a first material and a second portion 68 comprising a second material having at least one property that differs from the first material. The first and second materials can comprise any suitable materials. In some embodiments, both the first and second materials comprise reinforced composite materials comprising fibers (e.g. glass, carbon, polymer, etc) and a filler (e.g. resin). In some embodiments, the fibers of the first portion 66 are different from the fibers of the second portion 68. For example, in some embodiments, both the first portion 66 and the second portion 68 comprise glass fibers, but the first portion 66 comprises S-glass fibers and the second portion 68 comprises E-glass fibers. In some embodiments, the first portion 66 and second portion 68 comprise similar fiber types but comprise different filler materials to provide different strength characteristics.

In some embodiments, the second portion 68 is less resistant to deformation than the first portion 66. In some embodiments, the second portion 68 is weaker than the first portion 66.

In some embodiments, the second portion 68 extends in the direction of the weak deflection vector 82.

In some embodiments, a cross-sectional shape of the stiffener 50 is symmetrical across a bisecting axis 36. In some embodiments, a cross-sectional shape of the first portion 66 is asymmetrical across a bisecting axis 36. In some embodiments, a cross-sectional shape of the second portion 68 is asymmetrical across a bisecting axis 36. In some embodiments, a collective cross-sectional shape of the first portion 66 and the second portion 68 is symmetrical across a bisecting axis 36.

In some embodiments, the centroid of a stiffener 50 is aligned upon a central longitudinal 35 axis of the arrow 10.

Figure 13:
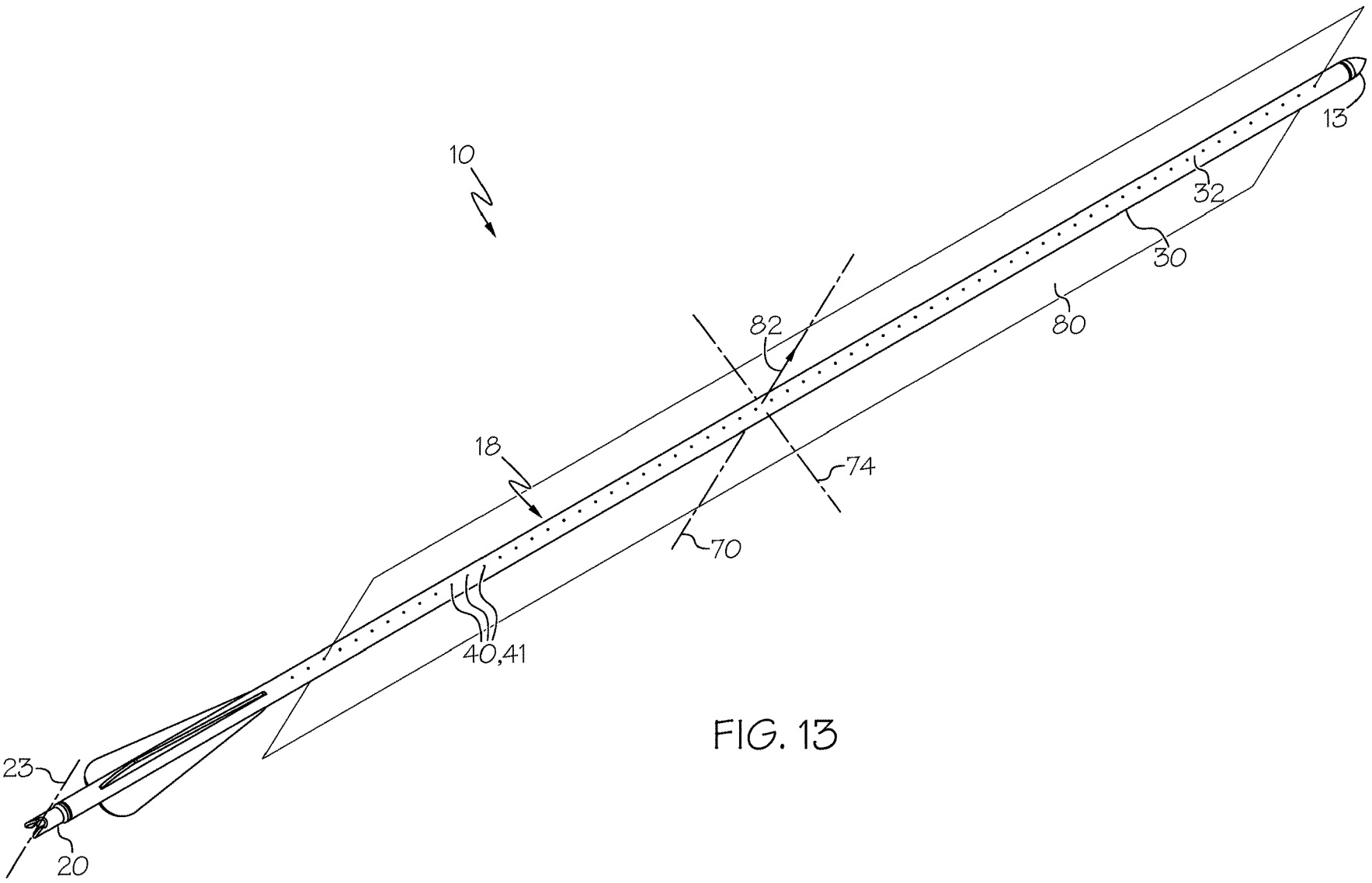
FIG. 13 shows another embodiment of an arrow.
Figure 14:
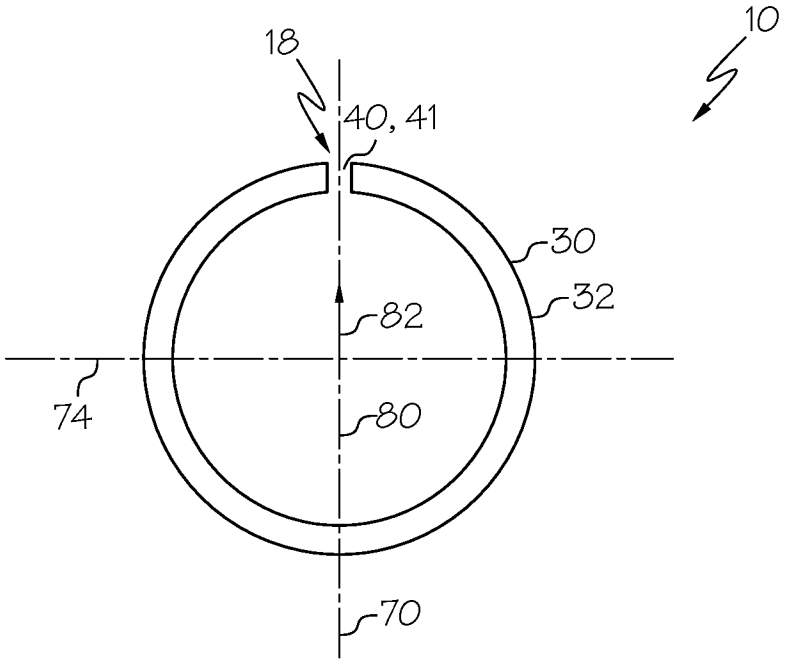
FIG. 14 shows a cross-sectional view of the embodiment of FIG. 13.

FIG. 13 shows another embodiment of an arrow 10, and FIG. 14 shows a cross-sectional view. In some embodiments, the shaft 30 comprises an asymmetrical feature 18 that locates the weak deflection vector 82 and/or the weak bending plane 80.

In some embodiments, the shaft 30 comprises a tube 32, and the tube 32 comprises the asymmetrical feature 18. In some embodiments, an arrow 10 does not include a stiffener as shown in some other embodiments.

In some embodiments, the shaft 30 comprises a cavity 40 formed in an outer surface of the shaft 30. In some embodiments, a cavity 40 comprises a blind hole or partial depth cavity extending into the sidewall of the tube 32. In some embodiments, a cavity 40 comprises an aperture 41 that extends through a full sidewall of the tube 32.

In some embodiments, an asymmetrical feature 18 comprises a plurality of cavities 40 aligned along a length portion of the arrow 10. In some embodiments, the cavities 40 are aligned along a reference axis that extends parallel to a central longitudinal axis of the arrow 10. In some embodiments, the aligned cavities 40 orient a weak bending plane 80 for the arrow 10. In some embodiments, the aligned cavities 40 orient a weak deflection vector 82 for the arrow 10.

In some embodiments, a cavity 40 or aperture 41 extends into the tube 32 in a radial direction of the shaft 30. In some embodiments, a longitudinal axis of the cavity 40 or aperture 41 is oriented parallel to the weak deflection vector 82. In some embodiments, a longitudinal axis of the cavity 40 or aperture 41 is oriented parallel to the nock axis 23.

Apertures 41 and cavities 40 can be made using any suitable method. In some embodiments, a tube 32 is formed, and the cavities/apertures 40, 41 are formed by removing material, for example by machining, cutting, laser ablation, etc.

Figure 15:
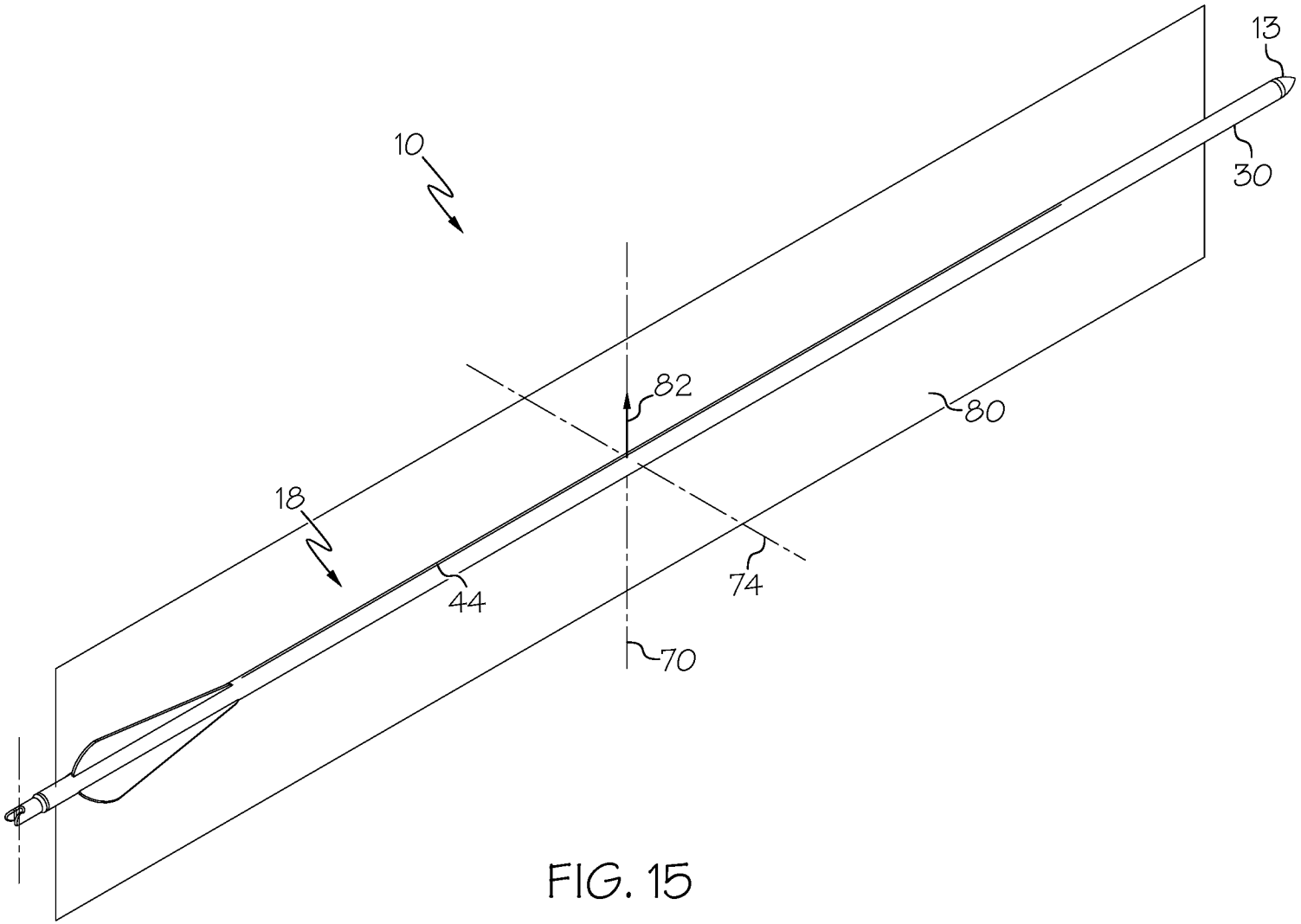
FIG. 15 shows another embodiment of an arrow.
Figure 16:
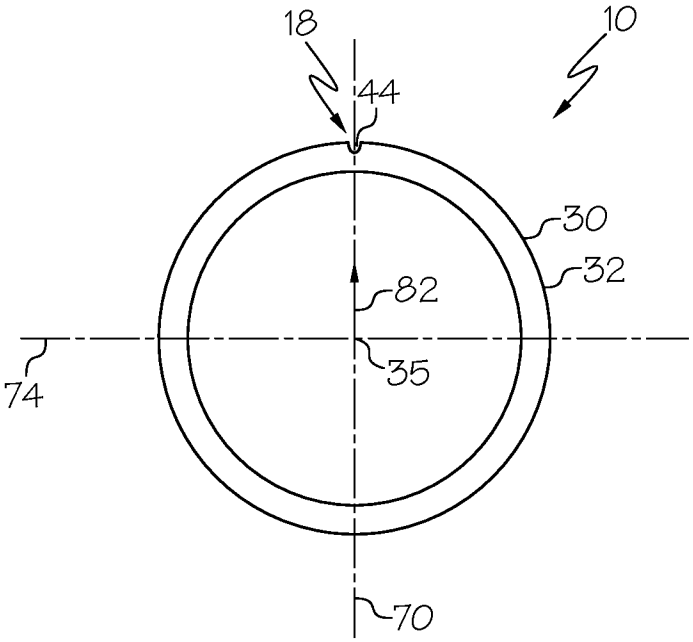
FIG. 16 shows a cross-sectional view of the embodiment of FIG. 15.

FIG. 15 shows another embodiment of an arrow 10, and FIG. 16 shows a cross-sectional view.

In some embodiments, an asymmetrical feature 18 comprises a score line 44, cut line, groove or other similar feature. In some embodiments, a score line 44 comprises an indentation formed in an outer surface of the shaft 30. In some embodiments, a score line 44 orients the weak bending plane 80 for the arrow 10. In some embodiments, a score line 44 orients the weak deflection vector 82 for the arrow 10.

A score line 44 can be formed using any suitable method. In some embodiments, a shaft 30 is formed comprising a score line 44, for example by extrusion. In some embodiments, a score line 44 is formed in a shaft 30 by removing material, for example by machining.

Figure 17:
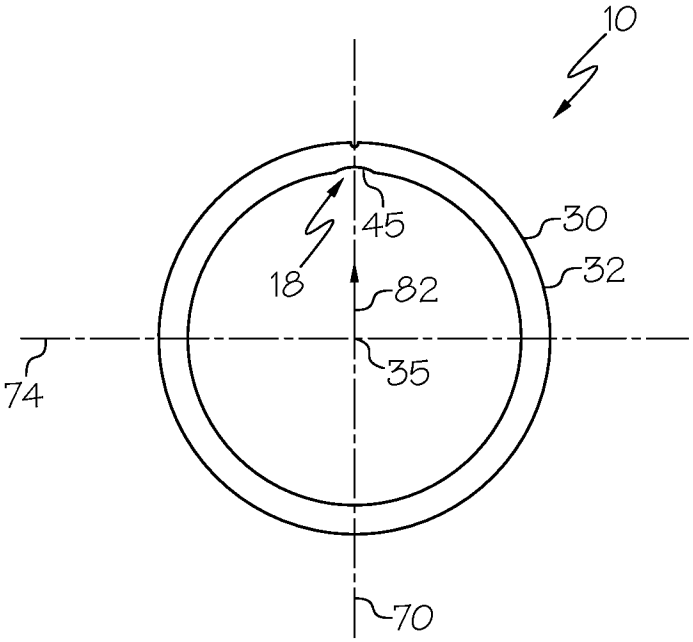
FIG. 17 shows a cross-sectional view of another embodiment of an arrow.

FIG. 17 shows another embodiment of a shaft 30. In some embodiments, an arrow 10 comprises an asymmetrical feature 18 is not visible from the exterior surfaces of the arrow 10.

In some embodiments, an asymmetrical feature 18 comprises recess 45 formed on an inner surface of a tube 32. A recess 45 can be formed using any suitable method. In some embodiments, a tube 32 is formed comprising a recess 45. In some embodiments, a tube 32 is formed by wrapping material around a mandrel, wherein the mandrel comprises a protrusion arranged to form the recess 45.

In some embodiments, a tube 32 comprises an asymmetrical inner surface. In some embodiments, a tube 32 is formed with an inner asymmetry. In some embodiments, an exterior surface of the tube 32 is machined (e.g. centerless grind) to create a symmetrical outer surface. A tube 32 according to FIG. 17 can be formed by wrapping material around an asymmetrical mandrel configured to create the recess 45. Any bulge in the outer surface of the tube 32 opposite the recess 45 can be removed, for example by grinding.

Figure 18:
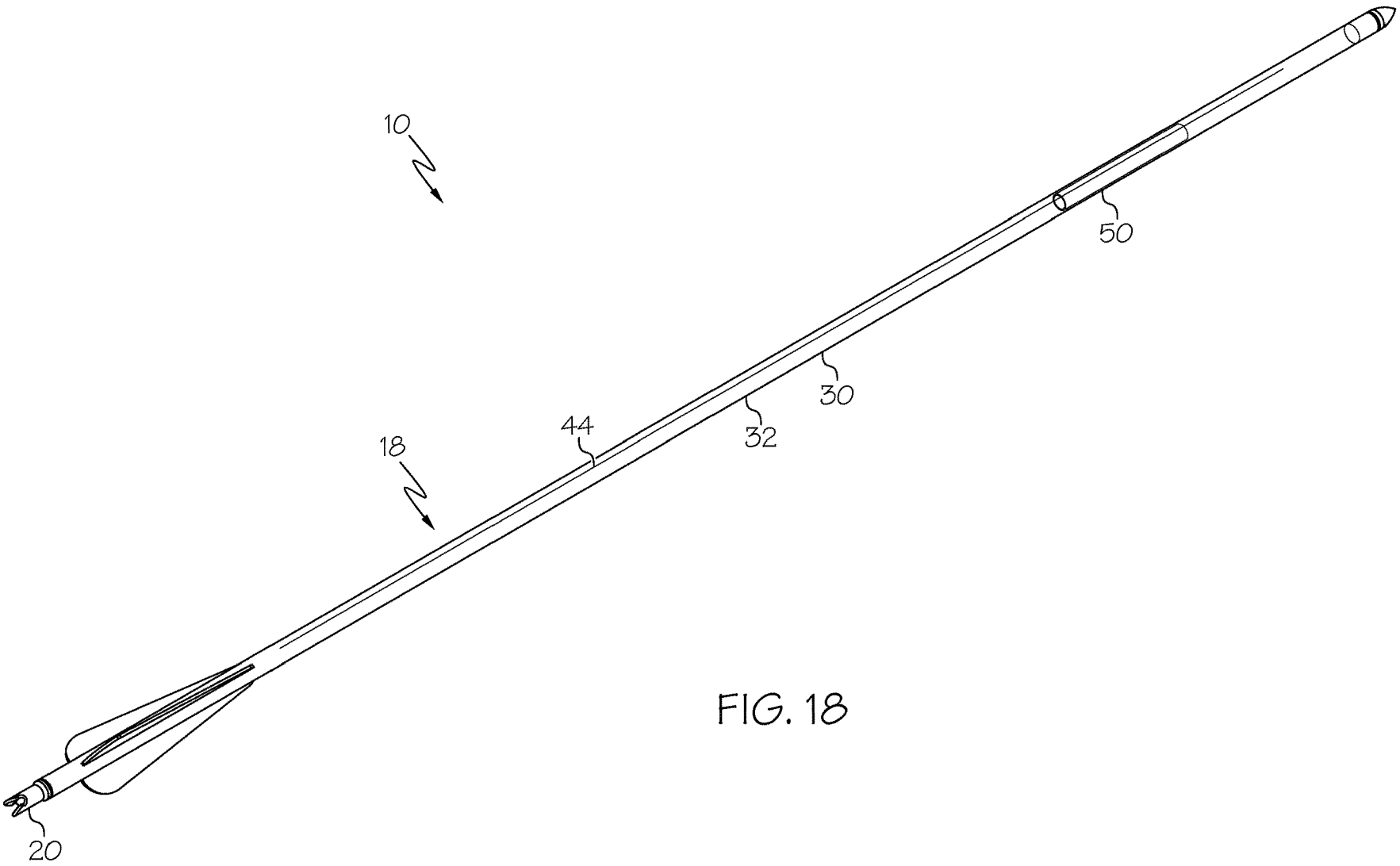
FIG. 18 shows another embodiment of an arrow.

FIG. 18 shows another embodiment of an arrow 10. In some embodiments, a shaft 30 comprises an asymmetrical feature 18, such as a groove 44, and the arrow 10 comprises a stiffener 50.

In some embodiments, a stiffener 50 is symmetrical and the arrow 10 comprises an asymmetrical feature 18 in the shaft 30.

Figure 19:
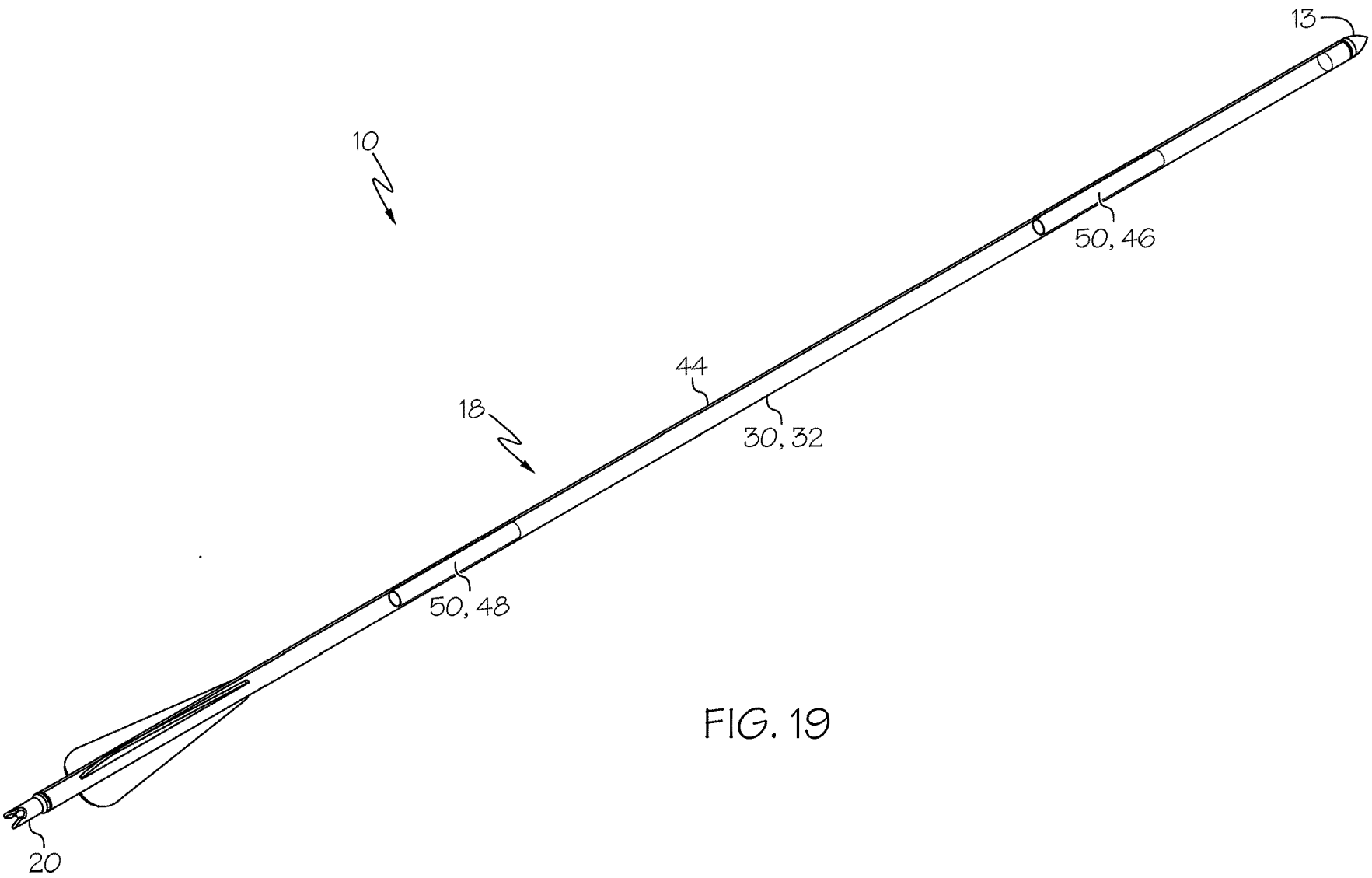
FIG. 19 shows another embodiment of an arrow.

FIG. 19 shows another embodiment of an arrow 10. In some embodiments, a shaft 30 comprises an asymmetrical feature 18, such as a groove 44, and the arrow 10 comprises a first stiffener 46 and a second stiffener 48.

Figure 20:
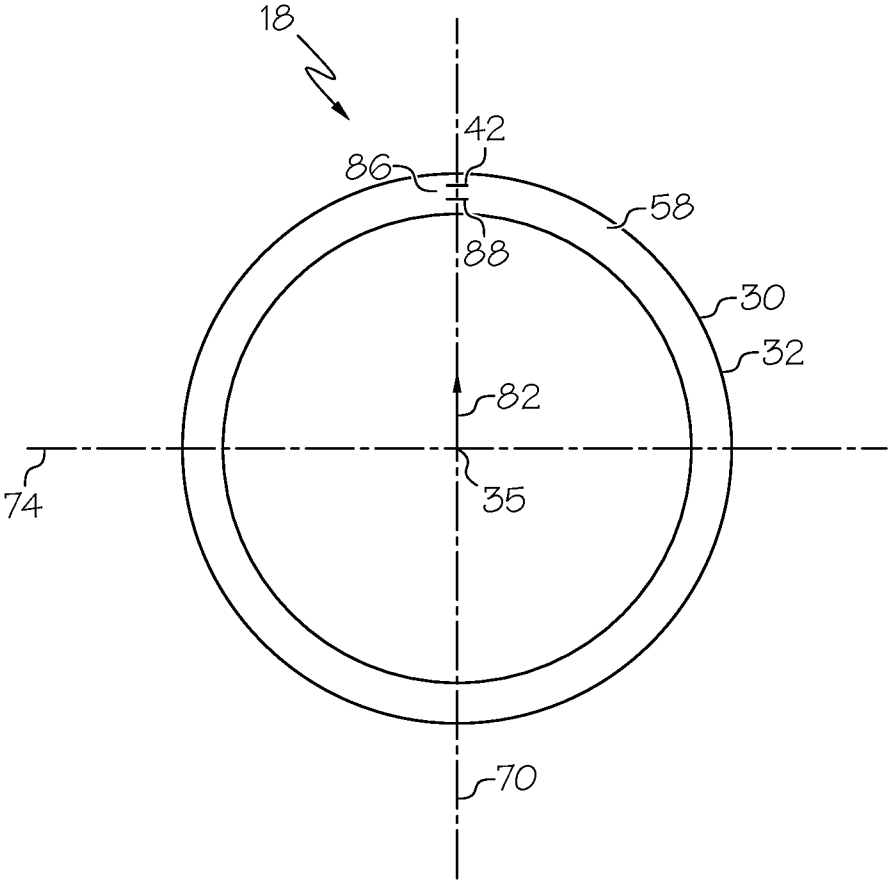
FIG. 20 shows a cross-sectional view of another embodiment of an arrow.

FIG. 20 shows another embodiment of an arrow 10. In some embodiments, the asymmetrical feature 18 is hidden in the thickness of the sidewall 58 of the tube 32.

In some embodiments, the shaft 30 comprises elongate structural fibers, such as glass fibers or carbon fibers. In some embodiments, the structural fibers comprise an asymmetrical feature 18.

In some embodiments, an asymmetrical feature 18 comprises a gap 42 in structural fibers that comprise the shaft 30. In some embodiments, certain fibers are cut or otherwise manipulated to provide a gap 42 in the structural fibers, thereby providing a shaft 30 with an oriented weak deflection vector 82. A gap 42 can be provided using any suitable method.

In some embodiments, an asymmetrical feature 18 comprises a different type of structural fibers. In some embodiments, a shaft 30 comprises first fibers 86 of a first type, and second fibers 88 of a second type arranged in an asymmetrical manner. In some embodiments, a longitudinal line of second fibers 88 extends along the length of the shaft 30. In some embodiments, the second fibers 88 are weaker than the first fibers 86, and the second fibers 88 provide a shaft 30 with an oriented weak deflection vector 82

The first and second fibers 86, 88 can comprise any suitable fibers, and the first fibers 86 can differ from the second fibers 88 in any suitable way. In some embodiments, the first fibers 86 and second fibers 88 comprise different materials, which may fall into different categories (e.g. carbon fibers and glass fibers). In some embodiments, first fibers 86 and second fibers 88 comprise materials falling into a common category but having different specific properties (e.g. PAN carbon fibers and pitch-based carbon fibers). In some embodiments, the first fibers 86 and second fibers 88 comprise similar materials that are arranged differently from one another (e.g. the first fibers 86 comprise a weave pattern that is different from the second fibers 88.)

Figure 21:
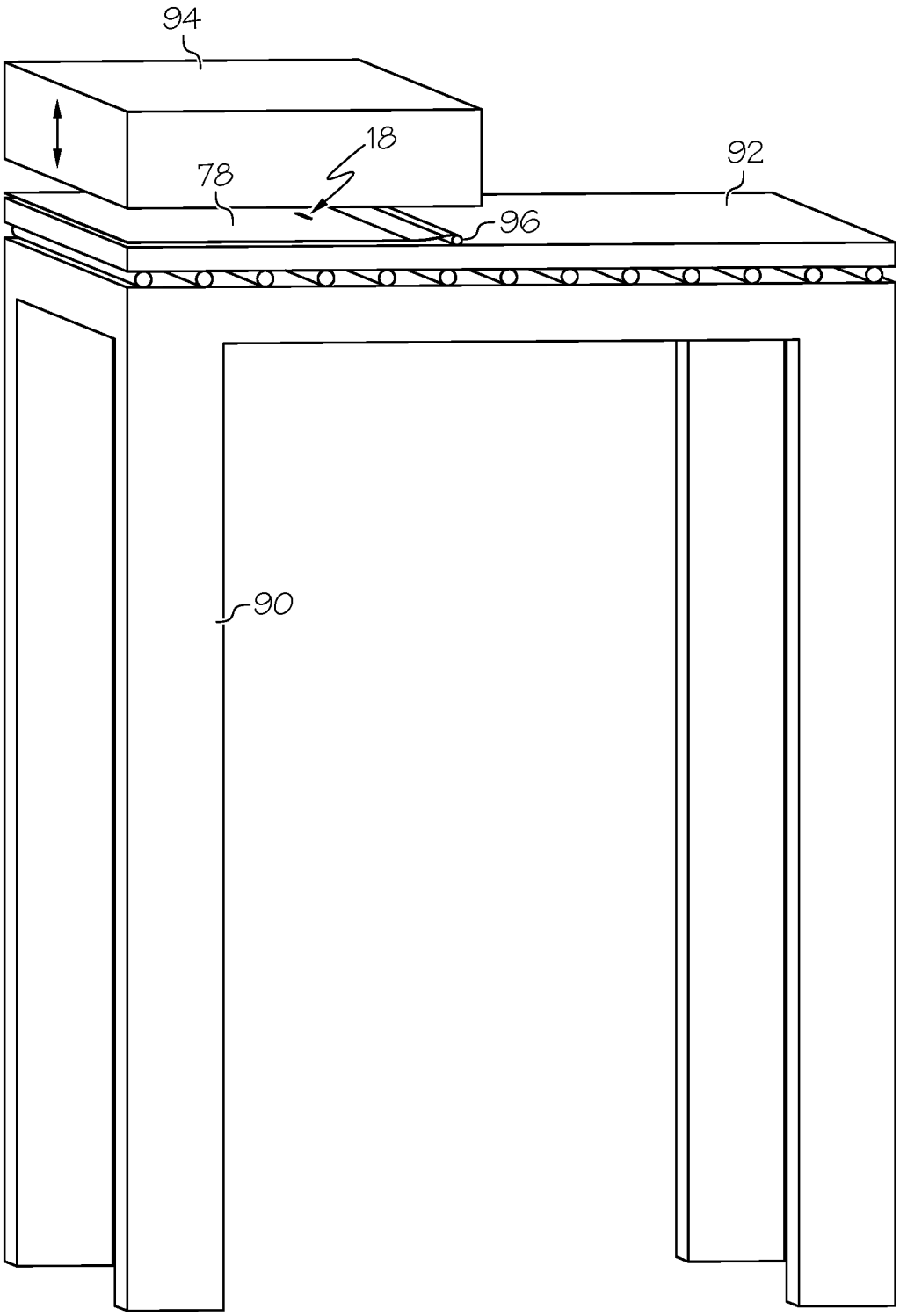
FIG. 21 shows an embodiment of a manufacturing step for an embodiment of an arrow.

FIG. 21 shows an embodiment of a manufacturing step to create a shaft 30 comprising an asymmetrical feature 18.

In some embodiments, a table 90 comprises a moving surface 92 (e.g. conveyor) and a fixture 94. A fiber preform 78 is oriented with respect to a mandrel 96. The moving surface 92 and fixture 94 can contact the fiber preform 78 and mandrel 96 and wrap the fiber preform 78 around the mandrel 96.

In some embodiments, the structure of the fiber preform 78 comprises the asymmetrical feature. In some embodiments, the fiber preform 78 comprises a gap in fibers or discontinuous fibers. In some embodiments, the fiber preform 78 comprises first fibers 86 and second fibers 88 in a selective arrangement to create an asymmetrical feature 18 in the final shaft 30.

In some embodiments, an arrow 10 comprises a front insert or outsert arranged to accept an arrowhead, for example with screw threads as known in the art. In some embodiments, the insert or outsert is configured to engage a stiffener 50 as taught herein with respect to an arrowhead 13.

In some additional embodiments, an arrow 10 is not required to comprise an asymmetrical feature. Referring again to FIG. 19, in some embodiments, an arrow 10 comprises stiffener(s) 50, 46, 48 arranged to set the locations of the nodes and anti-nodes of a standing wave vibration that is induced at arrow launch. In some embodiments, the shaft is symmetrical and the stiffeners are symmetrical.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An arrow comprising:

a tubular shaft comprising a sidewall and an inner cavity, an inner surface of the tubular shaft comprising a circular shape;

a nock; and a structural asymmetry orienting a weak bending axis of the arrow along its length, the asymmetry comprising a groove, a depth of the groove being less than a thickness of the sidewall;

the tubular shaft comprising a cross-section, a first half of the cross-section shaped differently from a second half of the cross-section.

2. The arrow of claim 1, the first half comprising the asymmetry.

3. The arrow of claim 1, the asymmetry extending an entire length of the shaft.

4. The arrow of claim 1, the shaft comprising the asymmetry.

5. The arrow of claim 4, the asymmetry formed in an outer surface of the shaft.

6. The arrow of claim 4, the shaft comprising a tube comprising an asymmetry formed in an inner surface of the tube.

7. The arrow of claim 4, the shaft comprising a tube and a stiffener.

8. The arrow of claim 4, the shaft comprising a plurality of cavities aligned in a lengthwise direction of the arrow.

9. The arrow of claim 4, the asymmetry hidden in a sidewall of the shaft.

10. The arrow of claim 4, the shaft comprising first fibers and second fibers.

11. An arrow comprising:

a tubular shaft comprising a longitudinal axis and an inner cavity, an inner surface of the tubular shaft comprising a circular shape;

a nock; and a structural asymmetry orienting a weak bending axis of the arrow, the shaft comprising the asymmetry, the asymmetry comprising a groove extending parallel to the longitudinal axis, the groove extending an entire length of the shaft.

12. The arrow of claim 11, an outer surface of the shaft comprising the groove.

13. The arrow of claim 11, an inner surface of the shaft comprising the groove.

14. An arrow comprising:

a tubular shaft comprising an inner surface and an outer surface, the inner surface comprising a circular shape;

a nock; and a structural asymmetry orienting a weak bending axis of the arrow along its length, the asymmetry comprising a score line in the outer surface, the score line extending parallel to a longitudinal axis of the tubular shaft.

15. The arrow of claim 14, the score line extending an entire length of the tubular shaft.

16. The arrow of claim 14, the score line positioned upon a radial vector of the shaft, the nock comprising a notch defining an axis, the radial vector parallel to the axis.

* * * * *